US006461405B2

(12) United States Patent
Reyes

(10) Patent No.: US 6,461,405 B2
(45) Date of Patent: Oct. 8, 2002

(54) METHOD OF OPERATING AN ELECTROSTATIC PRECIPITATOR

(75) Inventor: Victor Reyes, Søborg (DK)

(73) Assignee: F.L. Smidth Airtech A/S, Valby (DK)

( * ) Notice: Subject to any disclaimer, the term of this patent is extended or adjusted under 35 U.S.C. 154(b) by 0 days.

(21) Appl. No.: 09/810,659

(22) Filed: Mar. 19, 2001

(65) Prior Publication Data

US 2001/0011499 A1 Aug. 9, 2001

Related U.S. Application Data

(63) Continuation-in-part of application No. PCT/DK98/00405, filed on Sep. 18, 1998, now abandoned.

(51) Int. Cl.[7] ..... B03C 3/68

(52) U.S. Cl. ..... 95/7; 95/81; 96/24; 96/25; 96/82; 323/903

(58) Field of Search ..... 95/2–7, 26, 80, 95/81; 96/20–25, 80, 82; 323/903

(56) References Cited

U.S. PATENT DOCUMENTS

| | | | | | |
|---|---|---|---|---|---|
| 3,292,042 | A | * | 12/1966 | Michener et al. | 95/81 X |
| 3,984,215 | A | * | 10/1976 | Zucker | 95/81 |
| 4,311,491 | A | | 1/1982 | Bibbo et al. | 323/903 X |
| 4,522,635 | A | * | 6/1985 | Matts | 95/81 X |
| 4,592,763 | A | * | 6/1986 | Dietz et al. | 323/903 X |
| 4,665,476 | A | * | 5/1987 | Masada | 323/903 X |
| 4,690,694 | A | * | 9/1987 | Alig et al. | 95/81 X |
| 4,772,998 | A | * | 9/1988 | Guenther, Jr. et al. | 323/903 X |
| 4,779,182 | A | * | 10/1988 | Mickal et al. | 323/903 X |
| 4,936,876 | A | * | 6/1990 | Reyes | 95/81 X |
| 5,311,420 | A | * | 5/1994 | Zarfoss et al. | 95/6 X |
| 5,542,967 | A | * | 8/1996 | Ponizovsky et al. | 96/82 |
| 5,575,836 | A | * | 11/1996 | Sugiura et al. | 96/82 |
| 5,639,294 | A | * | 6/1997 | Ranstad | 96/21 X |
| 5,705,923 | A | * | 1/1998 | Johnson et al. | 323/903 X |
| 5,707,422 | A | * | 1/1998 | Jacobsson et al. | 95/7 X |
| 5,972,076 | A | * | 10/1999 | Nichols et al. | 96/82 X |

FOREIGN PATENT DOCUMENTS

| | | |
|---|---|---|
| EP | 0066950 | * 12/1982 |
| EP | 0 286467 | * 10/1988 |
| WO | 9011132 | 10/1990 |
| WO | 9310902 | 6/1993 |

OTHER PUBLICATIONS

Foreign Document Nos. 0066950 and 0286467 Were Cited in Specification.*

* cited by examiner

*Primary Examiner*—Richard L. Chiesa
(74) *Attorney, Agent, or Firm*—Jacobson Holman, PLLC

(57) ABSTRACT

A method of operating an electrostatic precipitator (7) includes feeding the precipitator with electric power generated by a power supply (10) according to a regime adapted to impart between the precipitator electrodes a voltage having a DC component and an AC component. A control unit (8) measures the electrode voltage, establishes a voltage peak value and a voltage mean value, and computes the product of peak value by mean value to arrive at an index of expected performance (IEP). Operating set points are tuned so as to maximize this index of expected performance.

26 Claims, 2 Drawing Sheets

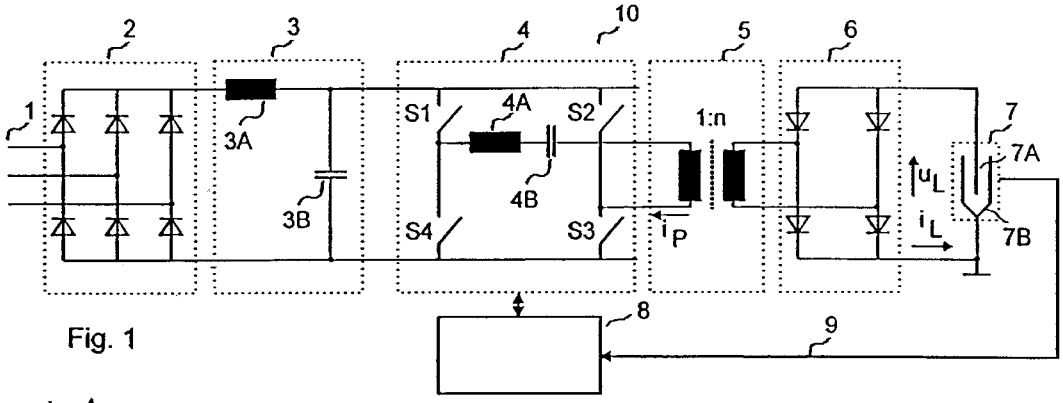
Fig. 1
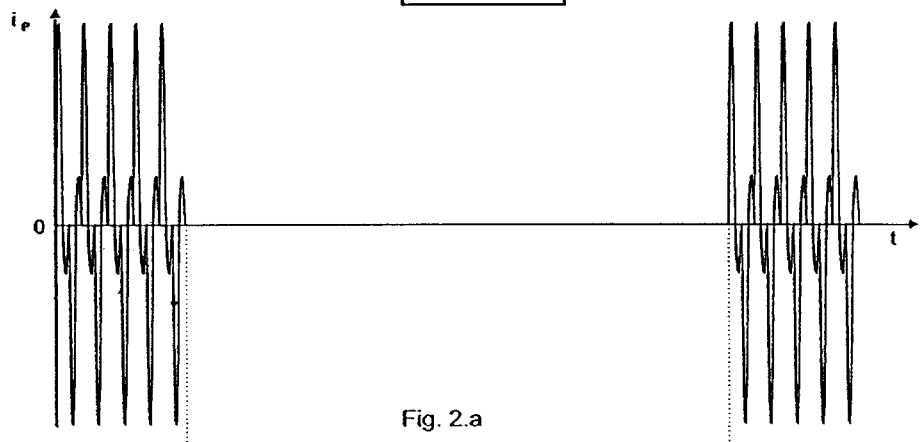
Fig. 2.a
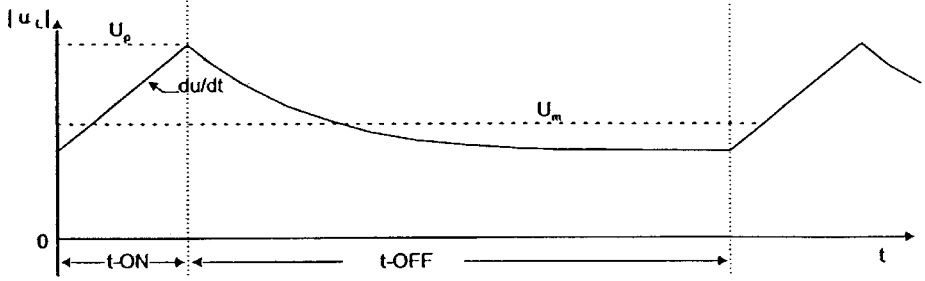
Fig. 2.b
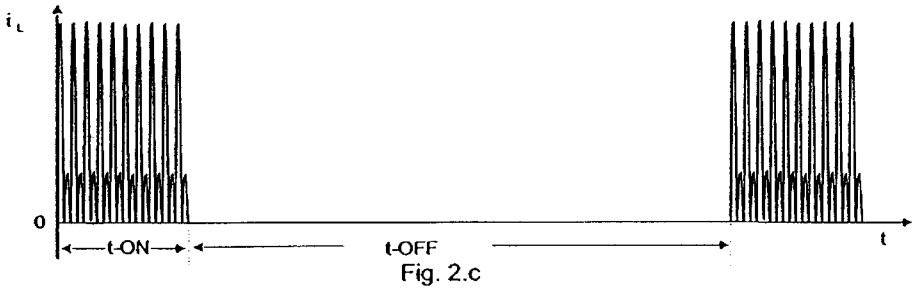
Fig. 2.c
Fig. 2 High ripple

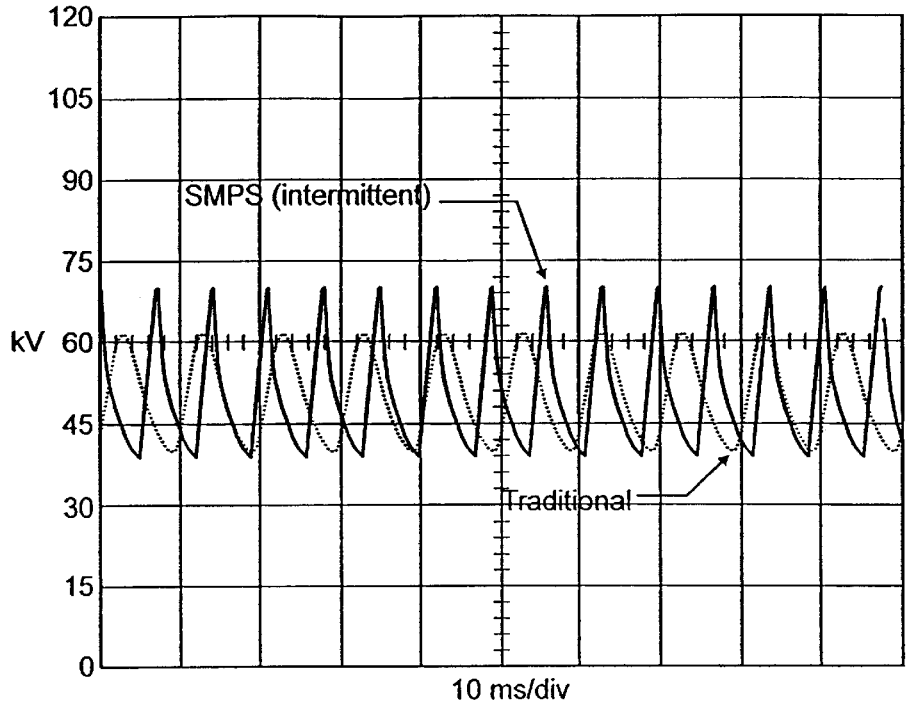
Fig. 3 Waveforms of the precipitator voltage
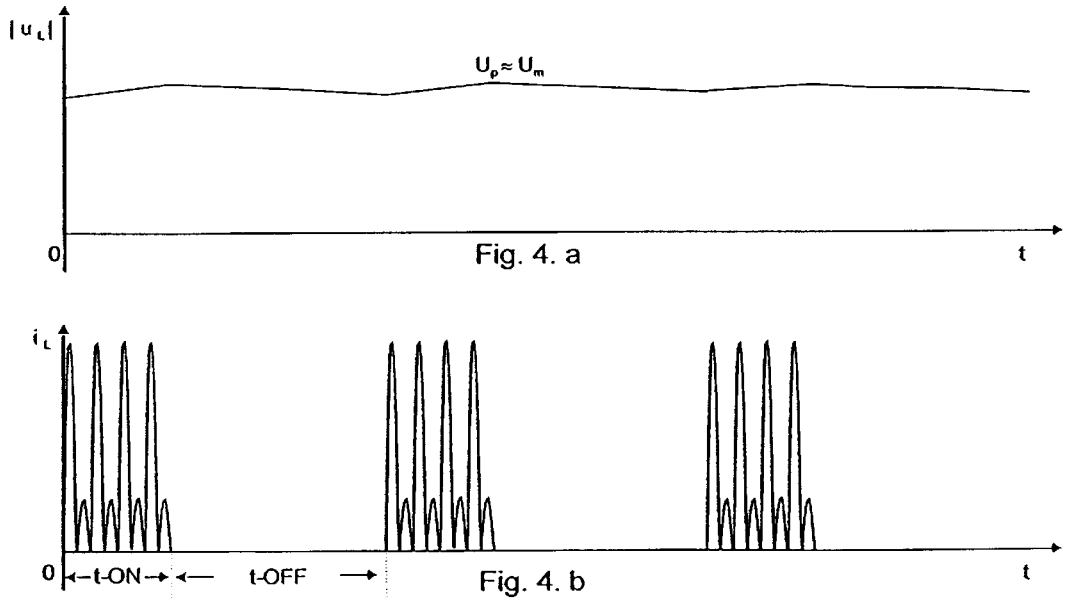
Fig. 4 Low ripple

METHOD OF OPERATING AN ELECTROSTATIC PRECIPITATOR

Cross-reference to Related Applications

This is a continuation-in-part of International Patent Application PCT/DK98/00405 with an international filing date of Sep. 18, 1998, now abandoned.

Background of the Invention

1. Field of the Invention

The present invention relates to a method of operating an electrostatic precipitator.

An electrostatic precipitator (abbreviated ESP) is a system for collecting solid particles, which operates by virtue of the movement of charges immersed in an electric field. An electrostatic precipitator has particular utility towards cleaning of flue gasses, smokes, etc. in order to remove particles of dust, ashes, soot, and the like. The gasses are made to pass through a zone wherein an electric field is directed transversely to the flow. The electric field is operated at a high voltage where a corona of free electrons is emitted from the negative electrode. The electrodes charge the particles and the charged particles will migrate under the effect of the electric field towards the positive electrode, usually designed in the form of collecting plates on which the particles deposit. On electric discharging of the particles at the positive electrodes and possibly aided by shaking the plates, the collected dust particles fall into a hopper located below the plates.

The collecting plates are usually grounded whereas the negative electrodes are constituted of thin metallic wires maintained at a high negative potential with respect to the plates.

By virtue of electrode geometry the electric field has a higher intensity adjacent the wire electrodes, which causes the ionization of the gas in the immediate surroundings and the creation of a corona. Towards the collecting plates the electric field is distributed over a larger area with a corresponding decrease of intensity. This lower intensity electric field may not be sufficient for the ionization of the gas but serves the purpose of advancing the charged particles of dust towards the collecting plates.

In a first approximation of electrical properties, the electrostatic precipitator may be represented by a capacitor with a shunt resistance that represents the leakage by the transport of charged particles between the electrodes. In order to produce ionization of the particles the electric voltage must surpass a certain minimum threshold referred to as the corona onset voltage. Upwardly the voltage will be limited by various factors depending on the mode of operation. One of these factors may be the formation of a sparkover between the electrodes, which may take the form of a short discharge or the form of a prolonged arc. Another factor recognized in the field is the formation of corona from points on the positive electrode referred to as back-corona. Back-corona represents an increase in the leak current and impairs the particle collection efficiency.

2. Description of the Prior Art

EP patent 0 286 467 suggests a power supply wherein the power fed from the mains grid into a step-up transformer is controlled through phase angle controlled thyristors, thus producing on the high voltage side pulses at double the mains frequency. The pulses charge the electrostatic precipitator to a varying voltage. According to this publication, a detection procedure is carried out at preselected time intervals wherein the power supply is blocked for a selected interval, such as from 0.1 to 5 seconds, and then resumed. The minimum values of the pulsed precipitator voltage is observed and the presence of back-corona is established if the minimum values observed after the blocked interval exceed the minimum value observed prior to the blocking interval by a detection sensitivity factor.

U.S. Pat. No. 5 311 420 suggests a power unit comprising mains powered silicon controlled rectifiers feeding into a step-up transformer. The power supply may run in intermittent energization mode wherein the precipitator is energized by a half cycle voltage pulse followed by a predetermined number of off cycles, the ratio of on to off half cycles being optimized to prevent back-corona. The back-corona condition is detected by detecting a lack of increase of the minimum peak values of output voltage of the high voltage rectifier coincident with an increase in an output current value.

U.S. Pat. No. 4 779 182 provides an inverter power supply with switches which may be operated to output a high frequency alternating current, alternating at a frequency from 1 to 3 kHz. The feed voltage may be specified and also the voltage ripple, i.e. the voltage fluctuation between an upper and a lower limit may be specified. The direct current taken from the high voltage rectifier can be interrupted by periodic blocking in order to enforce voltage ripple on the electrostatic precipitator.

EP patent 066 950 suggests a power supply effectively comprising two complete sets of thyristor controlled high voltage power units. The first set outputs a stable base voltage whereas the second set fires single pulses to be superimposed on the back ground level provided from the first set. The electrostatic precipitator voltage takes the form of a stable back ground level superimposed with pronounced spikes. The pulse duration is within the range 50 to 200 microseconds. WO-A1-9011132 discloses a method of operating an electrostatic precipitator, wherein the power fed to the high-voltage transformer primary is controlled by thyristors fed from the mains and variation of the pulse frequency is implemented by igniting the thyristors for every third, every fifth, every seventh etc. half-cycle. Thus this method only permits varying the OFF-time intervals. The precipitator voltage values measured are the voltages at the peak, at the end of the current pulse and at 1.6 ms after the end of the current pulse.

WO-A1-9310902 discloses a method where the power fed to the high-voltage transformer primary is controlled by thyristors fed from the mains. The voltage is measured 1–3 times per ms. A "figure of merit" is established using a formula involving the time integral of the square of the voltage. Variation of the pulse frequency is implemented by igniting the thyristors for only part of the half-cycles and by controlling the firing angle.

In operating conditions of high resistivity dust, the dust deposited on the plate electrode will resist discharging of the ionized particles. The voltage tends to increase across the dust layer, and to correspondingly decrease across the gas. If the voltage across the dust layer continues to build up, a point is reached where a dielectric break down through the dust layer occurs. This point is known as the onset point of the back corona discharge. The dielectric break down of the dust layer produces positive ions, which decrease particle charging, and result in a reduction of the collection efficiency.

The formation of back-corona takes some time, and this is related to the relaxation time of the dust layer.

As the dust layer can be considered as a leaky capacitor, it will tend to smooth out the current pulses delivered to the electrostatic precipitator. This effect may be put to advantage as short pulses may be applied to the electrodes without prompting the formation of back-corona on the dust layer. Rather the initiation of a back-corona situation seems to be governed by the time average value (mean value) of the precipitator current.

Therefore, in order to avoid or reduce the back-corona discharges, the mean current delivered to the precipitator has to be decreased. The problem is to do this without losing too much voltage level.

The basic control problem is then to determine the current that has to be delivered to the precipitator in accordance with the existing operating conditions. For some industrial processes, the dust resistivity can sometimes be low and sometimes be high, causing back-corona. In the first case the current has to be as high as possible, and in the second case the current has to be reduced.

The traditional power supply for ESP's used until now is a transformer rectifier set, consisting of a high voltage transformer and a bridge rectifier. A pair of antiparallel thyristors using phase angle control controls the primary voltage applied to the HV transformer.

A non-linear resistance in parallel with a capacitance may represent the ESP load. The capacitance for a medium size ESP bus-section is 60–80 nF (2000 $m^2$ collecting plate area). This means that the time constant of the load is in the millisecond range, causing the waveform of the voltage applied to the ESP to contain a considerable ripple. Therefore the voltage applied to the ESP can be characterized by its mean value, peak value and trough (minimum) value. The ripple is expressed as the peak value minus the minimum value.

The current delivered to the ESP consists of rectified sinusoidal-alike pulses whose amplitude and duration depend on the value of the phase angle. For normal conditions (no back-corona) an increasing current gives an increasing voltage mean value and voltage ripple. The current pulses has a duration shorter than the period of the line frequency (10 ms for a 50 Hz-line), but in case of very high dust resistivity the electrical charge delivered in one current pulse may be high enough to start back-corona discharges.

Furthermore, the occurrence of sparks, arcs and short-circuits inside the ESP cause current surges in the line current, which are normally limited by the inclusion of a linear inductance in series with the primary circuit.

The problems can be avoided by using a new type of power supply known as switch mode power supply (SMPS), operating at a switching frequency above the audible limit. The current delivered by an SMPS is pulses of short duration, in the range of 10 to 30 microseconds. This solution consists basically in replacing the phase control thyristors by a rectifier and a DC-AC inverter connected between the mains and the transformer rectifier, which in this case has to be designed to cope with high frequency. Among the various types of inverters available, it has been found that a series-resonant inverter provides several advantages in relation to ESP energization.

Such an inverter with an inductance and a capacitance in series makes it possible to deliver rectified sinusoidal current pulses to the ESP with a duration of 10 to 30 microseconds and provides natural current commutation. Moreover, by choosing the values of the series inductance and capacitance, it turns out that the duration and the amplitude of the current in the main circuit of the inverter and in the primary of the HV-transformer are only determined by these components and become independent of the ESP load.

Thus, this SMPS has the advantages of being capable of delivering electrical charge to the ESP in small amounts and of avoiding current surges as the current amplitude is determined by the resonant components of the inverter and not by the ESP load. In case of a short-circuit inside the ESP, the amplitude of the primary current is unchanged, and the line current falls to a low value. This beneficial effect is due to the fact that the mains have only to deliver power to cover the losses in the power supply, as the output power is zero.

This type of power supply has also another important feature. By using one or few current oscillations and then interrupting the power for a certain time the voltage waveform can in practice be a pure DC-voltage (no AC-component).

Furthermore, by operating the inverter to generate current oscillations during a longer time interval, e.g. during 1 to 2 milliseconds, the so-called ON-time, the precipitator voltage can be raised at a higher rate of rise compared with traditional energization. Thereafter the current oscillations are interrupted during a so-called OFF-time, where the precipitator voltage falls exponentially towards the corona onset value. In other words, this type of SMPS can produce different voltage waveforms on ESP loads, ranging from a practically pure DC-voltage to a very steep and pulsating voltage.

SUMMARY OF THE INVENTION

The invention, in a first aspect, provides a method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said ON-time interval and repeating the steps of monitoring and multiplying so as to establish a correlation of said index to said time variations, establishing a time value of said ON-time interval corresponding to a maximum of said index, and selecting said established time value as a new set point for said ON-time interval.

The invention, in a second aspect, provides a method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said OFF-time interval and repeating the steps of monitoring and multiplying so as to establish a correlation of said index to said time variations, establishing a time value of said OFF-time interval corresponding to a maximum of said index, and selecting said established time value as a new set point for said OFF-time interval.

The invention, in a third aspect, provides a method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said ON-time interval simultaneously with effecting successive incremental time variations of said OFF-time intervals and repeating the steps of monitoring and multiplying so as to establish a correlation of said index to said time variations, establishing a time value of said ON-time interval and a time value of said OFF-time interval corresponding to a maximum of said index, and selecting said respective established time values as new set points for said ON-time interval and said OFF-time interval.

The inventor has found that in adverse operating conditions, i.e. back-corona, and also in normal conditions, a pulsating precipitator voltage with a high rate of rise plays an important role in the collection efficiency.

The mean current can be controlled by means of the ON-time and the OFF-time, and the present invention deals with the control strategy for the determination of the appropriate values for the two time intervals, leading to the best collection efficiency for particular operating conditions of the precipitator.

The particle charging is proportional to the peak value of the precipitator voltage, while the force exerted on the charged particles for their removal from the gas stream is proportional to the mean value of the precipitator voltage. The inventor has found a good correlation between the particle collection efficiency and the product of the peak value and the time average of the precipitator voltage, so the control strategy should preferably be based on a criterion of maximizing the product of these two factors.

This is achieved by the invention as summarized above.

The method according to the invention provides an optimal strategy for selecting the best operating parameters, thereby improving collection efficiency. Further, the procedure for searching the optimum does not require departing from operating the ESP close to the optimal electrical conditions. This is advantageous in particular in view of the fact that searching in order to optimize operating parameters usually has to be carried out frequently to account for frequent variations in operating conditions. The method according to the invention permits a comparatively simple control strategy.

According to a preferred embodiment, power may be fed to the ESP intermittently, giving a pulsating voltage because of the RC nature of the ESP load. The power is delivered to the ESP as current bursts, adapted to raise the precipitator voltage at a rate of about 30 kV/ms. The substantial increase of precipitator voltage within a very short time permits the attainment of a high peak value with a comparatively lower risk of initiating a spark or a back-corona condition. On the other hand, this rate of rise is within the capabilities of a SMPS of a comparatively simple design.

The method according to the invention may be implemented using an inverter in the power supply that operates at a fixed switching frequency and with a well-defined current waveform consisting of sinusoidal pulses. This reduces the generation of higher harmonics and eliminates the current surges in the mains in case of sparks, arcs or short-circuits inside the ESP.

According to a preferred embodiment, the step of effecting successive incremental variations comprises varying the ON-time and the OFF-time, independently of each other or simultaneously.

This method is convenient in the process of finding an optimum set of operating parameters so as to ensure efficient operation. The power supply may comprise a control logic adapted to drive the solid state components so as to produce output power intermittently. This simplifies design and control of the power unit, and produces an output voltage exhibiting a low ripple content which has a favorable effect on the electrostatic precipitator efficiency.

Obviously the fact that the power supply is capable of outputting a high ripple output signal does not exclude that the power supply could be adapted with the option of switching to another function mode which might be appropriate in particular circumstances. Other function modes that are known in the art per se, may e.g. comprise a DC mode, sometimes referred to as a pure DC mode. The power supply according to the invention can easily be controlled in such way as to output a low ripple signal, e.g. by outputting a high frequency signal intermittently with a suitably fast switching between on and off phases.

BRIEF DESCRIPTION OF THE DRAWINGS

Further object, advantages, and features of the invention will appear from the appended description of preferred embodiments given with reference to the drawings wherein FIG. 1 shows an electric circuit diagram of the power supply implementing the method according to the invention, FIG. 2 shows a set of plots of voltage versus time for a mode of operation with a high ripple of the voltage, the set comprising three plots on mutually similar time scales, i.e.

FIG. 2*a* illustrating the output current from the inverter

FIG. 2*b* illustrating precipitator voltage, and

FIG. 2*c* showing the current fed into the electrostatic precipitator

FIG. 3 shows a plot of precipitator voltage on a compressed time scale, whereas FIG. 4 shows a pair of plots similar to parts of FIG. 2, but for a pure DC mode of operation, FIG. 4*a* is a plot similar to FIG. 2*b*, but for a pure DC mode of operation, and FIG. 4*b* is a plot similar to FIG. 2*c*, but for a pure DC mode of operation.

DESCRIPTION OF THE PREFERRED EMBODIMENTS

All figures are schematic, not necessarily to scale, and show only items essential to the understanding of the invention, whereas other items have been deleted for the sake of clarity.

Throughout the figures the same references are used for identical or similar items.

Reference is first made to FIG. 1, which illustrates a circuit diagram of a power supply implementing the method according to the invention, and connected to an electrostatic precipitator.

The power supply designated 10 essentially comprises a three-phase full wave rectifier bridge 2, a voltage smoothing circuit 3 essentially comprising choke 3A and storage capacitor 3B, high frequency inverter 4, step-up transformer 5, single-phase full wave high voltage rectifier 6, and control unit 8.

The power supply feeds electrostatic precipitator 7, which is of a conventional type, comprising grounded plate electrodes 7B and hot electrode 7A. As conventional in the art the electrostatic precipitator is fed with a high voltage of varying amplitude with the hot electrode 7A being fed with negative polarity.

As conventional in the art the electrostatic precipitator 7 also comprises sensing means such as a voltage divider and a current transformer (not shown) by which the electrostatic precipitator voltage $u_L$ and the current fed into the electrostatic precipitator $i_L$ can be measured, the measurement being transmitted through line 9 to the control unit 8.

The inverter 4 comprises four semi-conductor switches, which are controlled by the control unit 8. By suitable operation of the switches, current of alternating polarity may be fed through series inductance 4A, series capacitance 4B, and through the primary winding of the step-up transformer 5.

The series inductance 4A together with the series capacitance 4B together provide a series resonant circuit which is trimmed to conduct current oscillations at a predetermined operating frequency, e.g. in the order of 40 kHz, and so as to choke or block current at other frequencies.

The control unit 8 controls the firing of the semiconductor devices in the way to turn on the switches in alternating pairs, e.g. to turn on S1 together with S3 and, during a later phase, S2 together with S4. The switching intervals are matched to the operating frequency of the series resonance circuit so as to facilitate commutation and to ensure optimum operating efficiency. The switches comprise semi-conductor devices, e.g. field effect transistors or devices of the types known in the art by the designations IGBT, IGCT or others. Each switch is shunted with an antiparallel diode serving the purpose of conducting the primary current when this reverses polarity.

The implementation of the switch control so as to provide switch mode operation at a frequency tuned to a predetermined frequency value is considered to lie within the capabilities of those skilled in the art.

Reference is now made to FIG. 2 for a description of one mode of operation of the power supply 12 according to the invention. FIG. 2 comprises a set of three plots versus time. The plots are on identical time scales, FIG. 2*a* showing the inverter output current, FIG. 2*b* showing precipitator voltage, and FIG. 2*c* showing the amplitude of current fed to the precipitator. According to the mode of operation illustrated the high frequency inverter is operated intermittently, i.e. power is fed to the transformer during the time t-On, whereas inverter operation pauses during the subsequent time interval t-Off. This pattern is repeated cyclically. During the active interval t-On, the inverter oscillates at a comparatively high frequency, e.g. 40 kHz.

The durations could be e.g. on for 2 ms and pause for 8 ms. Thus one On-interval would comprise a train of 160 (half wave) pulses.

Power is transformed to high voltage in the step-up transformer and rectified on the high voltage side, and causes the charging of the precipitator capacitance, thus raising precipitator voltage. During the off time the precipitator voltage decays, the electric charge on the electrostatic precipitator being discharged by migration of ionized particles in the electrostatic precipitator.

The control unit continually monitors the electrostatic precipitator voltage and computes the voltage peak value $U_p$, generally prevailing at the end of the On-interval, and also the electrostatic precipitator voltage mean value $U_m$. The control unit computes an index of expected performance IEP by $U_p$ multiplied by $U_m$. The control unit may run the operation according to fixed set points for t-On and t-Off or it may perform a searching procedure aimed towards optimizing the operating parameters.

One mode of performing a searching procedure comprises making a planned variation of t-Off while keeping t-ON to a constant value. The index IEP is computed so as to establish a list of values of IEP related to different values of T-Off. Optimum electrostatic precipitator performance is expected for maximum value of IEP. Thus a value of t-Off producing the maximum value of IEP is selected for the new set point.

The searching procedure may be carried out at intervals or it may be performed continually by continually causing small perturbations of t-Off and logging any change of IEP.

Another searching procedure may comprise keeping t-Off constant while varying t-On. Apart from this modification the second searching procedure is carried out similar to the first searching procedure.

FIG. 3 shows a plot of the electrostatic precipitator voltage (numerical value) at a compressed time scale as compared to that of FIG. 2. FIG. 3 shows in full line the voltage as produced by the mode of operation explained with reference to FIG. 2, whereas the dotted curve in FIG. 3 illustrates the electrostatic precipitator voltage as provided by a different mode of operation. The mode of operation illustrated by the dotted curve produces a pulsating voltage with rising portions which are not as steep as those illustrated by the solid line. This is illustrative of the performance achieved by power supplies operating on the mains frequency, which may have a ripple at double the mains frequency.

Conversely, the voltage plotted in solid line exhibits a saw tooth ripple with steep rising portions. This voltage may be produced by the power supply according to the invention.

Both curves in FIG. 3 illustrate modes of operation at the highest voltage found possible without entering a state of back-corona. Both curves hover about the same mean value. However, whereas the sinusoidal ripples peak just above 60 kV (negative polarity), the saw tooth ripples peak at above 70 kV. The electrostatic precipitator particle collection efficiency of the electrostatic precipitator is related to the product of the mean value the peak value of the precipitator voltage. Then, the collection efficiency obtained energizing the precipitator with the described SMPS is expected to be higher than the one obtained with traditional energization as illustrated with the dotted line.

Reference is now made to FIG. 4 for a description of a different mode of operation of the power supply according to FIG. 1.

FIG. 4 shows three time plots similar to those of FIG. 2. The mode of operation according to FIG. 4 is distinguished by the durations of the On-intervals as well as of the Off-intervals being substantially shorter than those of FIG. 2. Thus according to FIG. 4 the On-time could be 100 microseconds and the Off-time 200 microseconds. This will produce a low ripple on the electrostatic precipitator voltage as appears from the plot in FIG. 4*a*. A low ripple of the electrostatic precipitator voltage may be beneficial under some operating conditions, mainly with very low resistivity dust.

A full-scale test has been run in order to verify the effectiveness of the method according to the invention. Some results from the test are given as an example.

An electrostatic precipitator bus section of 1,200 $m^1$ collecting plate area and section capacitance 50 nF was used.

The electrostatic precipitator was fed with gas carrying high-resistivity dust. Tests were performed with the precipitator powered by means of a 30 kHz switch mode power supply, which was run in intermittent energization mode. The intermittent energization mode comprises alternating on-intervals and off-intervals. The control unit permits independent tuning of the on-intervals and of the off-intervals. The on-intervals were set at 1,8 ms, sufficient to increase precipitator voltage from 30 kV, the corona on set voltage, to very close to 90 kV, the maximum rated voltage within one on-interval.

Instrumentation was provided to measure peak voltage and mean voltage of the electrostatic precipitator hot electrode and to measure emission, i.e. residual content of dust in the gas discharged. During a first run, the strategy used to determine the optimum point of operation was based on observing the minimum values of the pulse precipitator voltage during intervals, in which the power supply is blocked, i.e. a strategy similar to that described in EP patent 0286467. During a second run, the strategy used for optimizing the operating parameters comprised varying the setting of the off-intervals while taking readings of peak voltage and of mean voltage and computing the product of these two factors for respective settings, and selecting for set-points of operation the pair of settings maximizing this product.

Results from the test are given in table 1 below:

| Method | t-OFF | Umean | Upeak | IEP | Emission |
|---|---|---|---|---|---|
| Old | 18 $\mu$s | 34 kv | 65 kv | 2.210 $kV^2$ | 133 $mg/Nm^3$ |
| New | 6 $\mu$s | 39 kv | 66 kv | 2.574 $kV^2$ | 119 $mg/Nm^3$ |

Thus, the result of the test verifies the superior performance obtained by operating the precipitator according to the set points established by the new optimization strategy.

Although specific embodiments have been explained above it should be remembered that the invention may be carried out in several ways, and that the explanation merely serves to exemplify the invention and not to limit its scope as defined exclusively by the appended claims.

I claim:

1. A method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said ON-time interval and repeating the steps of monitoring and multiplying so as to establish a correlation of said index to said time variations, establishing a time value of said ON-time interval corresponding to a maximum of said index, and selecting said established time value as a new set point for said ON-time interval.

2. The method according to claim 1, wherein the step of effecting successive incremental variations comprises effecting successive incremental time variations of said OFF-time intervals simultaneously with the effecting successive incremental variations of said ON-time interval.

3. The method according to claim 2, wherein the step of effecting successive incremental variations comprises effecting a simultaneous variation of the ON-time interval and the OFF-time interval in such way as to keep the voltage mean value substantially constant.

4. The method according to claim 2, wherein the step of effecting successive incremental variations comprises effecting a simultaneous variation of the ON-time interval and the OFF-time interval in such way as to keep the voltage peak value substantially constant.

5. The method according to claim 1, wherein power is delivered to the electrostatic precipitator as bursts of current pulses providing a power input sufficient to raise the precipitator voltage at a rate of at least 30 kV/ms.

6. The method according to claim 5, wherein the current bursts comprise current pulses pulsating at a frequency of at least 20 kHz.

7. The method according to claim 1, wherein power is delivered to the electrostatic precipitator as bursts of current pulses, each burst of current pulses providing a power input sufficient to raise the precipitator voltage from the corona on-set voltage to the maximum rated voltage.

8. The method according to claim 1, wherein power is fed to the electrostatic precipitator in surges adapted to raise the precipitator voltage by a rate of at least 10 kV/ms.

9. A method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said OFF-time interval and repeating the steps of monitoring and multiplying so as to establish a correlation of said index to said time variations, establishing a time value of said OFF-time interval corresponding to a maximum of said index, and selecting said established time value as a new set point for said OFF-time interval.

10. The method according to claim 9, wherein the step of effecting successive incremental variations comprises effecting successive incremental time variations of said ON-time intervals simultaneously with the effecting successive incremental variations of said OFF-time interval.

11. The method according to claim 10, wherein the step of effecting successive incremental variations comprises effecting a simultaneous variation of the OFF-time interval and the ON-time interval in such way as to keep the voltage mean value substantially constant.

12. The method according to claim 10, wherein the step of effecting successive incremental variations comprises effecting a simultaneous variation of the OFF-time interval and the ON-time interval in such way as to keep the voltage peak value substantially constant.

13. The method according to claim 9, wherein power is delivered to the electrostatic precipitator as bursts of current pulses providing a power input sufficient to raise the precipitator voltage at a rate of at least 30 kV/ms.

14. The method according to claim 13, wherein the current bursts comprise current pulses pulsating at a frequency of at least 20 kHz.

15. The method according to claim 9, wherein power is delivered to the electrostatic precipitator as bursts of current pulses, each burst of current pulses providing a power input sufficient to raise the precipitator voltage from the corona on-set voltage to the maximum rated voltage.

16. The method according to claim 9, wherein power is fed to the electrostatic precipitator in surges adapted to raise the precipitator voltage by a rate of at least 10 kV/ms.

17. A method of operating an electrostatic precipitator, comprising the steps of intermittently feeding the precipitator with electric power according to a cycle comprising a controlled preset ON-time interval and a preset OFF-time interval in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said ON-time interval simultaneously with effecting successive incremental time variations of said OFF-time intervals and repeating the steps of monitoring and multiplying so as to establish a correlation of said index to said time variations, establishing a time value of said ON-time interval and a time value of said OFF-time interval corresponding to a maximum of said index, and selecting said respective established time values as new set points for said ON-time interval and said OFF-time interval.

18. The method according to claim 17, wherein the step of effecting successive incremental variations comprises effecting a simultaneous variation of the ON-time interval and the OFF-time interval in such way as to keep the voltage mean value substantially constant.

19. The method according to claim 17, wherein the step of effecting successive incremental variations comprises effecting a simultaneous variation of the ON-time interval and the OFF-time interval in such way as to keep the voltage peak value substantially constant.

20. The method according to claim 17, wherein power is delivered to the electrostatic precipitator as bursts of current pulses providing a power input sufficient to raise the precipitator voltage at a rate of at least 30 kV/ms.

21. The method according to claim 20, wherein the current bursts comprise current pulses pulsating at a frequency of at least 20 kHz.

22. The method according to claim 17, wherein power is delivered to the electrostatic precipitator as bursts of current pulses, each burst of current pulses providing a power input sufficient to raise the precipitator voltage from the corona on-set voltage to the maximum rated voltage.

23. The method according to claim 17, wherein power is fed to the electrostatic precipitator in surges adapted to raise the precipitator voltage by a rate of at least 10 kV/ms.

24. A method of operating an electrostatic precipitator, comprising the steps of intermittently feeding the precipitator with electric power according to a cycle comprising during a controlled preset ON-time interval a burst of current pulses, pulsating at a frequency of at least 20 kHz and providing to the precipitator a power input sufficient to raise the precipitator voltage at a rate of at least 30 kV/ms, and during a preset OFF-time interval a pause in the feeding in order to apply to the precipitator electrodes a cyclic time-varying voltage, monitoring the electrode voltage and establishing a voltage peak value and a voltage mean value, multiplying the established peak value with the established mean value to compute an index of expected performance (IEP), effecting successive incremental time variations of said ON-time interval simultaneously with effecting successive incremental time variations of said OFF-time intervals and repeating the steps of monitoring and multiplying so as to establish a correlation of said index to said time variations, establishing a time value of said ON-time interval and a time value of said OFF-time interval corresponding to a maximum of said index, and selecting said respective established time values as new set points for said ON-time interval and said OFF-time interval.

25. The method according to claim 24, wherein power is fed to the electrostatic precipitator in surges adapted to raise the precipitator voltage by a rate of at least 20 kV/ms.

26. The method according to claim 24, wherein power is fed to the electrostatic precipitator in surges adapted to raise the precipitator voltage by a rate of at least 30 kV/ms.

* * * * *